313-413 SR
12/23/80 OR 4,241,275

United States Patent [19]

Yamauchi

[11] 4,241,275

[45] Dec. 23, 1980

[54] IN-LINE TYPE ELECTRON GUN STRUCTURE FOR COLOR PICTURE TUBES

[75] Inventor: Masaaki Yamauchi, Tougane, Japan

[73] Assignee: Hitachi, Ltd., Tokyo, Japan

[21] Appl. No.: 24,992

[22] Filed: Mar. 29, 1979

[30] Foreign Application Priority Data

Apr. 7, 1978 [JP] Japan ..... 53-40303

[51] Int. Cl.[3] ..... H01J 29/50; H01J 29/56; H01J 29/76

[52] U.S. Cl. ..... 313/413; 313/414; 313/453

[58] Field of Search ..... 313/413, 414, 453

[56] References Cited

U.S. PATENT DOCUMENTS

| | | | |
|---|---|---|---|
| 3,603,839 | 9/1971 | Takayanagi | 313/414 X |
| 3,852,608 | 12/1974 | Johanns et al. | 313/449 |
| 3,881,136 | 4/1975 | Scheele | 313/453 |
| 3,919,583 | 11/1975 | Hasker et al. | 313/414 X |
| 3,952,224 | 4/1976 | Evans, Jr. | 313/414 |

FOREIGN PATENT DOCUMENTS

| | | |
|---|---|---|
| 46-4712 | of 1971 | Japan . |
| 47-4317 | of 1972 | Japan . |
| 47-18781 | of 1972 | Japan . |
| 49-15359 | of 1974 | Japan . |
| 49-58745 | of 1974 | Japan . |

*Primary Examiner*—Palmer C. Demeo
*Attorney, Agent, or Firm*—Charles E. Pfund

[57] ABSTRACT

In an in line type electron gun structure for a color picture tube wherein electron guns are arranged in line, the electron-beam-pass apertures of at least one set of corresponding electrodes of the respective electron guns for forming pre-focus lens are made rectangular having corners in the directions of the horizontal and vertical deflection magnetic fields.

6 Claims, 13 Drawing Figures

IN-LINE TYPE ELECTRON GUN STRUCTURE FOR COLOR PICTURE TUBES

BACKGROUND OF THE INVENTION

The present invention relates to electron gun structures, and more particularly an in line type electron gun structure capable of improving the focusing characteristics over all the screen of color picture tube.

Conventionally known color picture tubes of a shadow mask type were first introduced to the public in 1972 by RCA, USA. Since this color picture tube was a self-convergence type using an integral in line electron gun structure, it has radically rationalized color picture tubes and color television sets and today, has been most popular. However, in the color picture tube constructed as above, the focusing characteristics are quite degraded, because the three electron guns are integrally arranged in line without modifying the inner diameter of the neck used heretofore in delta configuration, that is, the neck inner diameter adapted to house three electron guns arranged in delta configuration, thereby making the diameter of the electrode group forming electron lens substantially smaller and automatically increasing the spherical aberration of the electron lens.

Further, self-convergence system forms a strong pin cushion distortion in the horizontal deflection magnetic field and a strong barrel distortion in the vertical deflection magnetic field. Thus, the electron beams which was originally round is subjected to the distortions of the deflection magnetic fields and greatly distorted in its spot shape at the periphery of the color picture tube screen, thereby deteriorating the focus on the screen.

In order to recover the focus property impaired by the spherical aberration, the potential difference between the electrodes in the electron beam constituting the main lens is decreased and the focus voltage is increased to decrease the spherical aberration so that the diameter of the electron beam in the main lens is increased. As a result, interacting repulsive force of electrons in the electron beam is decreased to thereby decrease the divergence of the electron beam, attaining a small spot diameter. Among other measures to improve the focus property, there is proposed an expedient wherein the main lens is divided into a plurality of sub-lenses to gradually focus the electron beam, thereby decreasing the spherical aberration substantially and increasing the electron beam diameter in the main lens and consequently, the divergence of electron beam to be focused on the fluorescent screen is decreased; such an expedient uses, for example, so-called multi-stage focusing type electron gun such as high bi-potential gun, high uni-potential gun, tri-potential gun for improving the focusing property discussed above. Although thus improved focusing property is particularly remarkable in the center of the fluorescent screen of the color picture tube, they become conversely inferior at the periphery of the screen. This is due to the effect of the self-convergence type deflection magnetic fields wherein the above discussed strong distortions are quite evident. In other words, due to the fact that the diameter of the electron beam is increased in the main lens, angle of the electron beam with respect to the deflection magnetic field is increased as the electron beam passes through the deflection magnetic field. For these reasons, the electron beam is accompanied by an oval core in the x-axis direction and a halo in the y-axis direction of color picture tube, for instance, at the corners of the color picture tube.

SUMMARY OF THE INVENTION

The present invention intends to obviate the above mentioned drawbacks and has its object to provide an in-line type electron gun structure for a color picture tube which can improve focus characteristics at the center and the peripheral part of the fluorescent screen by correcting an adverse affect of deflection magnetic field which otherwise would impair focusing properties.

To accomplish the above object, there is provided according to the invention an in line type electron gun structure for a color picture tube wherein electron guns respectively comprise a cathode, a pre-focus lens member including first, second, and third electrodes arranged successively in alignment with and opposite to the cathode and forming a pre-focus lens when a predetermined voltage is applied on these electrodes, and a main lens member forming a main lens when a predetermined voltage is applied to the third electrode and additional electrodes, the first to third electrodes of respective electron guns having apertures arranged on the same plane for passing the electron beam, characterized in that at least one set of corresponding electrodes of the respective electron guns of the first to third electrodes forming the pre-focus lens have each a rectangular aperture having corners in the directions of the horizontal and vertical deflection magnetic fields.

DESCRIPTION OF THE PREFERRED EMBODIMENTS

Figure 1:
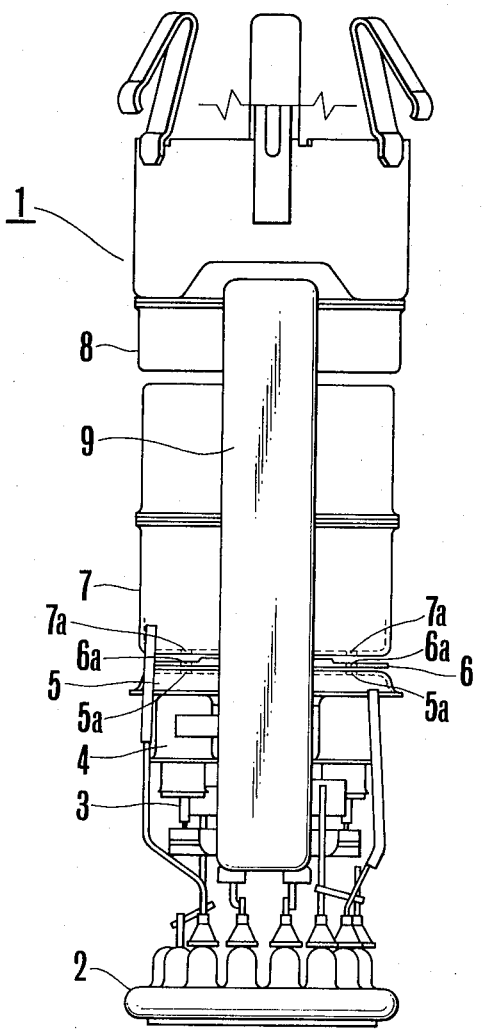
FIG. 1 is a side view of one embodiment of an electron gun structure according to the invention, particularly of a high bi-potential type electron gun structure.

FIG. 1 is a side view showing one embodiment of an in line type electron gun structure for a color picture tube in accordance with the present invention, and more particularly that of bi-potential electron gun structure. In FIG. 1, an electron gun structure 1 has electron guns for red, blue and green colors arranged in line independently of each other on a 6 stem 2 to be sealed to the neck of a color picture tube (not shown), which stem fixedly supports the electron gun structure 1. The respective electron guns comprise a heater 3 and a cathode 4 to emit electron beams, a first grid electrode (G1) 5 to control the electron beam, a second grid electrode (G2) 6 to accelerate the electron beam, third and fourth electrodes (G3, G4) 7 and 8 to form a main lens when applied with a predetermined voltage. These members are aligned successively at a predetermined interval and fixedly supported by the glass bead 9 to constitute a so-called in line type electron gun structure. In the first grid electrode (G1) 5, the second grid electrode (G2) 6 and third gride electrode (G3) 7 are formed apertures 5*a*, 6*a* and 7*a* to let the electron beams pass therethrough.

The apertures 5*a* of respective electron guns are arranged on the same plane as are the apertures 6*a* and 7*a*. The ends of first and third grid electrodes where the apertures are formed are shaped like a cup whereas the second grid electrode is generally flat. Predetermined voltages are respectively applied to the first to third grid electrodes to form pre-focus lens.

Figure 2:
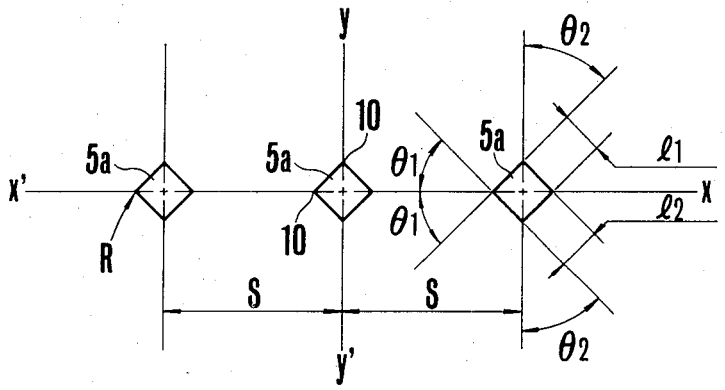
FIG. 2 is a plan view of rectangular apertures in accordance with the present invention.

According to the present invention, apertures 5*a*, 6*a*, 7*a* of the first to third grid electrodes are rectangular having corners 10 in the directions of the axes X and Y of the color picture tube as shown in FIG. 2 (although the figure shows only 5*a*, this illustration applies to other apertures).

More particularly, the diagonal direction of X–X′ across the corners 10 of this rectangular aperture 5*a* coincides with the direction of the vertical deflection magnetic field while that of Y–Y′ coincides with the direction of horizontal deflection magnetic field. Dimensions of sides $l_1$ and $l_2$ of the rectangular aperture 5*a* determine the size of aperture and are made slightly larger than the diameter of the conventional circular aperture. The rectangular apertures 5*a*, 6*a* and 7*a* provided respectively on the first grid electrode (G1) 5, second grid electrode (G2) 6 and third grid electrode (G3) 7 have dimensions different from each other.

Where $l_1=l_2$ 0.67 mm, 0.67 mm and 1.5 mm are for dimensions of one side of the apertures 5*a*, 6*a* and 7*a*, respectively. Angle $\theta_1$ and $\theta_2$ between one side of the diamond-shaped aperture and X and Y axes are in the following relation: $\theta_1=\theta_2=45$, and a pitch S between adjacent electron guns arranged in line is about 6.6 mm while a radius R of the corner 10 of appertures 5*a*, 6*a* and 7*a* is 0.02 to 0.05 mm.

The electron gun structure as constructed above is incorporated in a color picture tube. Under the conditions that spacings between the first grid electrode 5 and the second grid electrode 6 and between the second grid electrode 6 and the third grid electrode 7 are 0.3 mm and 1 mm, respectively, the color picture tube was operated by applying voltages of 0 V, 300–700 V, 7,000 V and 25 kV to the first to fourth electrodes 5, 6, 7 and 8, respectively, applying a video signal of 140 to 170 V to cathode 4, and supplying a cathode current of 4 mA.

Results showed that although the distortion in the electron beam spot shape attributable to the distorted magnetic field for self-convergence is strongly affected in the X and Y directions in respect of the tube axis, the electron beam, which has already been distorted by the apperture 5*a*, 6*a* or 7*a* into a substantial square form inclined by 45° relative to X and Y axes before entering the deflection magnetic field, is mitigated in its distortion by the deflection magnetic field, thereby producing an extremely excellent electron beam spot shape on the fluorescent screen.

The beam spot shapes formed by conventional circular apertures in the first (G1), the second (G2) and the third (G3) grid electrodes are compared with those formed by the present invention rectangular apertures 5*a*, 6*a* and 7*a*, and results are shown in FIGS. 3*a*, 3*b*, 4*a* and 4*b*. FIG. 3*c* shows the positions of the electron beams presenting the spot shapes of FIGS. 3*a* and 3*b* on the overall fluorescent screen.

Figure 3A:
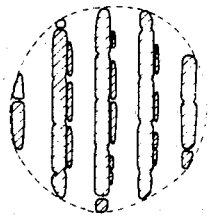
FIG.3a ( PRIOR ART )
FIGS. 3*a* and 3*b* are diagrams showing electron beam spot shapes at the center and corner of the screen in accordance with the prior art high bi-potential type electron gun structure.
Figure 3B:
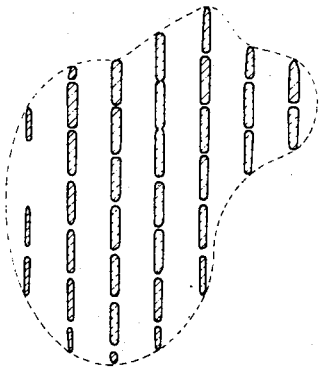
FIG.3b ( PRIOR ART )
Figure 3C:
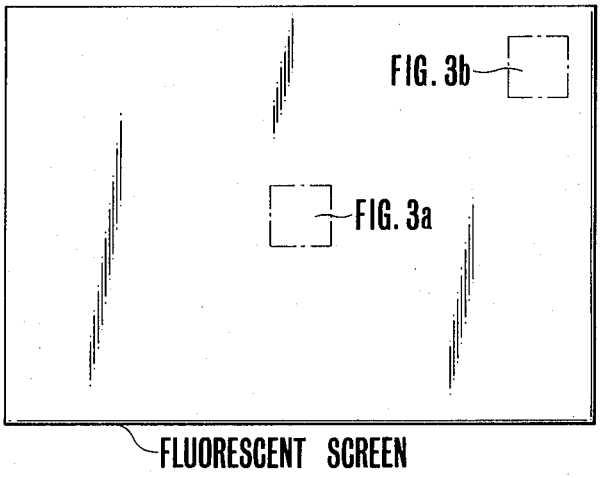
FIG. 3*c* is a diagrammatic representation to show the locations of electron beams of FIGS. 3*a* and 3*b;*
Figure 4A:
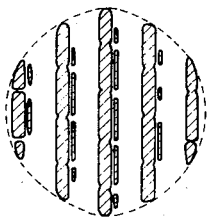
FIGS. 4*a* and 4*b* are diagrams showing electron beam spot shapes at the center and corner of the screen in accordance with a high bi-potential electron gun structure of the invention.
Figure 4B:
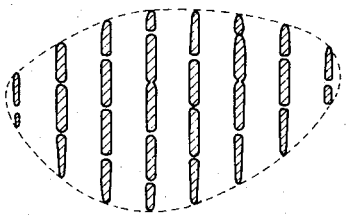

As shown in FIG. 3*a*, the contour indicated by dotted lines of the spot shape formed at the center of the fluorescent screen by the electron beam passing through conventional circular apertures presents an excellent roundness and a small spot diameter, whereas the contour of the spot shape at the corner of the fluorescent screen is not exactly round and the diameter is large. FIGS. 4*a* and 4*b* respectively show the spot shapes of electron beam passing through rectangular apertures of the above embodiment at the center and the corner of the fluorescent screen. In FIGS. 3*a*, 3*b*, 4*a* and 4*b*, there is applied a focus voltage to reduce the beam spot diameter to a minimum unaccompanied by halo at the center of the fluorescent screen. Accordingly, when electron beam spot diameters of FIGS. 3*a* and 3*b* (prior art) and of FIGS. 4*a* and 4*b* (the present invention) are compared, there is observed hardly any changes at the center of the fluorescent screen as shown in FIG. 4*a* while the shape at the corner presents improved roundness and beam diameter as shown in FIG. 4*b*, indicating that the focusing characteristic has been improved to a degree that it can be used practically.

Figure 5:
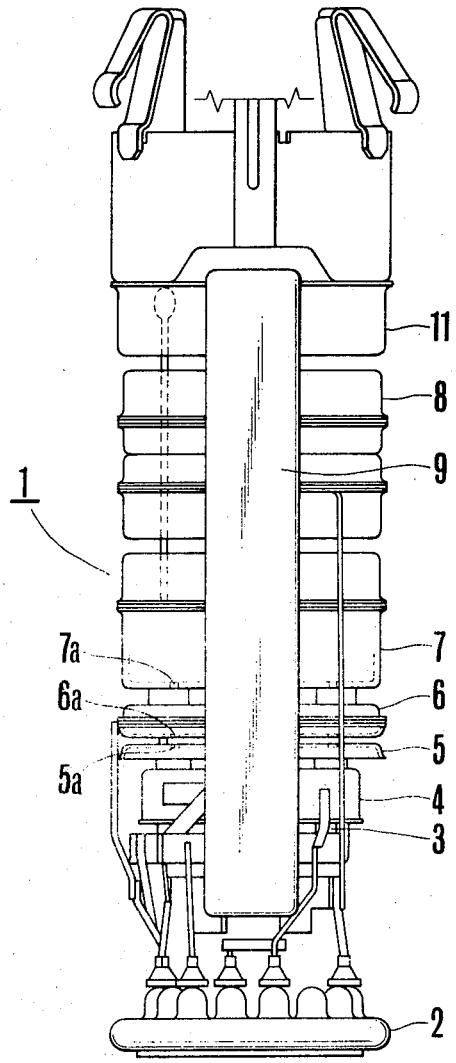
FIG. 5 is a side view of an embodiment of an electron gun structure in accordance with the present invention, particularly of a high uni-potential type electron gun structure.

FIG. 5 shows another embodiment of an electron gun structure, particularly that applied to high uni-potential type electron gun wherein the same reference numerals denote the same elements as in FIG. 1. The embodiment shown in this figure is different from that of FIG. 1 in that a fifth grid electrode (G5) 11 is fixedly supported on the same axis by the glass bead 3 at a predetermined distance away from the fourth grid electrode (G4) 8. The second grid electrode (G2) 6 is shaped like a cup while apertures 5*a*, 6*a*, 7*a* constructed identically to that shown in FIG. 2 are provided on the first grid electrode (G1) 5, the second grid electrode (G2) 6 and the third grid electrode (G3) 7, thereby constituting a high uni-potential electron gun structure.

The high uni-potential electron gun structure constructed as above is incorporated in a color picture tube and is operated, for instance, by providing the spacings of 0.3 mm and 2.3 mm between the first grid electrode 5 and the second grid electrode 6 and between the second grid electrode 6 and the third grid electrode 7; applying voltages of 0 V, 300–700 V, 25 kV, 9.5 kV, and 25 kV respectively to the first to fifth grid electrodes 5, 6, 7, 8 and 11, applying a video signal of 140–170 V to the cathode 4 and feeding a cathode current of 4 mA. The operational effects thus achieved are identical to those of the embodiment discussed before.

Figure 6A:
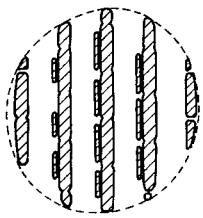
FIG.6a ( PRIOR ART )
FIGS. 6*a* and 6*b* are diagrams showing electron beam spot shapes at the center and corner of the screen formed by the conventional high uni-potential type electron gun structure.
Figure 6B:
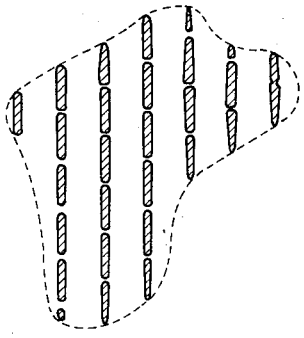
FIG.6b ( PRIOR ART )
Figure 7A:
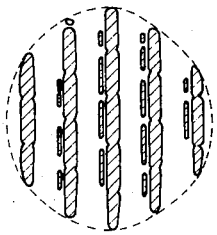
FIGS. 7*a* and 7*b* are diagrams showing electron beam spot shapes at the center and the corner of the screen formed by the high uni-potential type electron gun structure of the present invention.
Figure 7B:
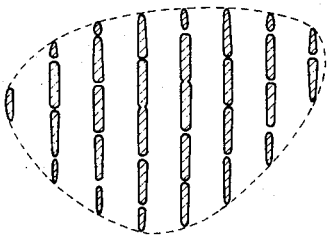

FIGS. 6*a* and 6*b* show the electrode beam spot shapes formed by the electron beam that has passed the prior art circular aperture at the center and the corner of the fluorescent screen, respectively and FIGS. 7*a* and 7*b* show those formed by the electron beam that has passed through the rectangular apertures of the present invention. As is evident from comparison of these two sets of drawings, the spot shape at the corner is improved of its focus property to a degree that is practically useful while that at the center is unchanged.

In the prior art the focus voltage at the peripheral part of the fluorescent screen was higher than that at the center because of a longer focus distance. In the present invention, however, substantially square distortion at the appertures 5*a*, 6*a* and 7*a* are adjusted to enforce the correcting effect by the difference in the focusing voltage, thereby eliminating the focusing voltage difference between the center and the peripheral portion.

Figure 8:
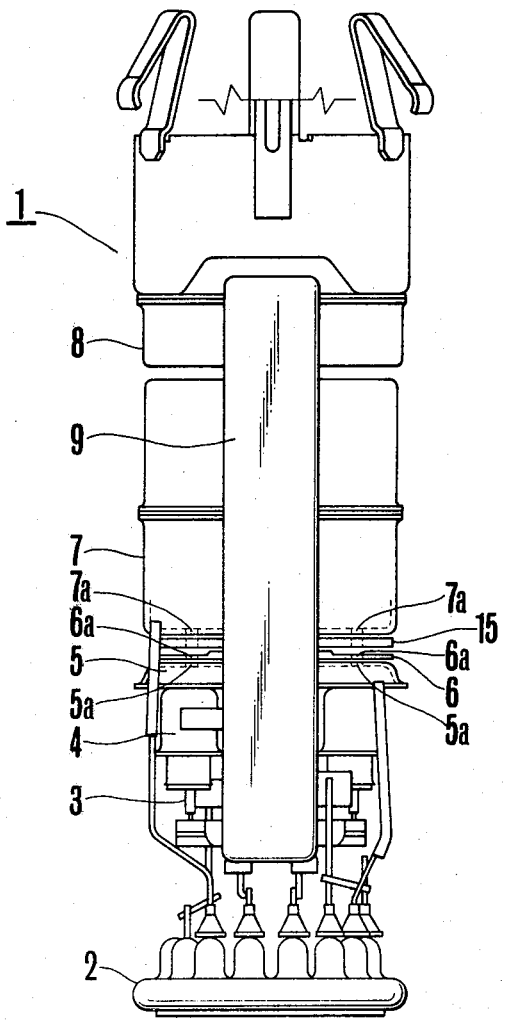
FIG. 8 is a side view of one embodiment of the electron gun structure in accordance with the present invention, more particularly that of an electron gun structure having an auxiliary electrode for focus adjustment.

FIG. 8 shows another embodiment of an electron gun structure to which the present invention has been applied wherein a focus adjusting auxiliary electrode 15 is provided between the second grid electrode and the third grid electrode. When incorporating the rectangular apertures, this type of electron gun structure can also attain the same effect as the previous embodiments.

Although the present invention has been described by way of the embodiments wherein rectangular apertures are provided at the first grid electrode (G1), the second grid electrode (G2) and the third grid electrode (G3) respectively, the invention is not to be limited to the above. Providing a rectangular aperture on at least one set of the above mentioned electrodes will be effective except that the degree of effectiveness may vary. Although the smaller the radius R of the corner of the rectangular aperture, the greater the achieved effect will be, the combination thereof can be arbitrary in design. The same is true of the inclination angle.

The rectangular aperture was described as diamond shaped in the above embodiments, but the invention naturally is not to be limited to the diamond shape alone. Any rectangular shapes which are symmetrical in respect of axis X will achieve the same effects as discussed hereinabove.

According to the electron gun structure of the present invention, it is possible to improve the focusing characteristics on substantially the whole area of the fluorescent screen of the color picture tube including its center and corners, thereby offering high quality color picture tubes.

What is claimed is:

1. In an in line type electron gun structure for a color picture tube wherein electron guns respectively comprise a cathode, a pre-focus lens member including first, second, and third electrodes arranged successively in alignment with and opposite to the cathode and forming a pre-focus lens when a predetermined voltage is applied to these electrodes, and a main lens member forming a main lens when a predetermined voltage is applied to the third electrode and additional electrodes, the first to third electrodes of respective electron guns having apertures arranged on the same plane for passing the electron beam, the improvement wherein at least one set of corresponding electrodes of the respective electron guns of the first to third electrodes forming the pre-focus lens have each a rectangular aperture having corners in the directions of the horizontal and vertical deflection magnetic fields.

2. An electron gun structure as recited in claim 1 wherein said aperture is provided for said first, second and third electrodes.

3. An electron gun structure as recited in claim 1 or claim 2 wherein said aperture is diamond shaped.

4. An electron gun structure as recited in claim 1 wherein the main lens is a bi-potential type.

5. An electron gun structure as recited in claim 1 wherein the main lens is a unipotential type.

6. An electron gun structure as recited in claim 1 which further comprises a focus adjusting auxiliary electrode between said second and third electrodes.

* * * * *